US007311202B2

(12) United States Patent
Chen

(10) Patent No.: US 7,311,202 B2
(45) Date of Patent: Dec. 25, 2007

(54) COMBINATIVE CABINETS

(76) Inventor: Feng-Kuei Chen, P.O. Box 90, Tainan City 704 (TW)

( * ) Notice: Subject to any disclaimer, the term of this patent is extended or adjusted under 35 U.S.C. 154(b) by 572 days.

(21) Appl. No.: 10/933,246

(22) Filed: Sep. 3, 2004

(65) Prior Publication Data

US 2006/0049075 A1 Mar. 9, 2006

(51) Int. Cl.
*B65D 21/028* (2006.01)

(52) U.S. Cl. ..... 206/504; 206/503; 206/509; 206/821; 220/23.2; 220/23.4; 220/23.6; 220/23.83

(58) Field of Classification Search ..... 206/504, 206/503, 505, 821; 220/23.6, 23.2, 4.26
See application file for complete search history.

(56) References Cited

U.S. PATENT DOCUMENTS 2,457,842 A * 1/1949 Smith et al. ..... 220/1.5
3,087,459 A * 4/1963 Dirck ..... 119/455
3,103,278 A * 9/1963 Kuzma et al. ..... 206/433
3,811,747 A * 5/1974 Levin ..... 312/308
3,828,964 A * 8/1974 Bonnot ..... 220/1.5
3,989,140 A * 11/1976 Crane ..... 206/597
4,108,511 A * 8/1978 Spragg, Jr. ..... 312/9.35
4,287,997 A * 9/1981 Rolfe et al. ..... 220/1.5
4,455,011 A * 6/1984 Levine ..... 248/646

* cited by examiner

*Primary Examiner*—Anthony D. Stashick
*Assistant Examiner*—Robert J Hicks

(57) ABSTRACT

A combinative cabinet includes a cabinet body formed with five sideboards with an open front side. An upper, a lower, a right and a left sideboard are respectively provided with two dovetail-shaped projections spaced apart by a same shaped groove or two same-shaped grooves spaced apart with a dovetail-shaped projection, and an L-shaped groove respectively formed at two rear corners of the upper, the lower, the right and the left sideboard. Then plural sets of two assembled cabinet bodies are combined together by juxtaposing and superposing modes, and this assembling method is repeatedly used for forming a large mass of plural combinative cabinets assembled together with convenience, fastness and stability.

3 Claims, 6 Drawing Sheets

COMBINATIVE CABINETS

BACKGROUND OF THE INVENTION

1. Field of the Invention

This invention relates to combinative cabinets, particularly to ones respectively having a cabinet body consisting of five sideboards for an upper side, a lower side, a right side, a left side, and a rear side with an open front side. The upper and the lower sideboard are provided with two dovetail-shaped projections spaced apart by a dovetail groove or with two dovetail-shaped grooves spaced apart by a dovetail projection. And the right and the left sideboards are also provided with the same dovetail-shaped projections and the dovetail-shaped grooves, and L-shaped grooves formed respectively on two corners of rear side of the upper and the lower sideboard and the right and the left sideboard for H-shaped position members of fit in four H-shaped grooves of two combined cabinet bodies in a juxtaposed side-to-side or back-to-back condition so that every two cabinet bodies can be combined together by juxtaposing or superposing them to form a set of two combined cabinets in the side-by-side or the back-to-back condition or the overlapped condition. In this way a large number of the cabinet bodies can be assembled together to form a large mass of plural assembled cabinets with convenience, fastness and stability. Thus, the provision of the dovetail-shaped projections, the dovetail-shaped grooves and the position members can keep stably a large mass of plural cabinets combined together by superposing, juxtaposing side by side and back to back with convenience, fastness and easiness.

2. Description of the Prior Art

Conventional cabinets generally consist of plural sideboards 10 for a bottom, a left side, a right side, topside and a rear side adhered or nailed together to form a single cabinet 1. In case a large mass of plural cabinets are to be combined together, as shown in FIG. 1, plural cabinets 1 are superposed and juxtaposed, and then using U-shaped clamps 11 for catching hold of the edges of two neighboring boards of two cabinets 10, finishing combination of the plural cabinets.

However, this kind of combination for the conventional cabinets by means of U-shaped clamps 11 cannot secure the combined conventional cabinets stably, prone to let the clamps 11 fall off and destabilize the whole cabinet mass because of no positioning means in the rear side of them in case of the conventional cabinets 1 receiving accidental shocks or collisions. Further, in positioning the two conventional cabinets positioned with a rear side against a rear side, probably fastening members such as screws or bolts are used for screwing tightly together the rear boards of the two cabinets, resulting in much time needed for the work.

SUMMARY OF THE INVENTION

The purpose of the invention is to offer combinative cabinets possible to be assembled with one another with convenience, quickness and stability for forming a large mass of plural combined cabinets.

The feature of the invention is plural sideboards for forming an upper, a lower, a right, a left, and a rear side of a cabinet body, and the upper, the lower, the right and the left sideboards are respectively provided with dovetail-shaped projections or grooves on an outer edge of an outer surface for engaging with one another in case two cabinet bodies are superposed and juxtaposed side by side or back to back. Further, L-shaped grooves are formed at each corner of a rear edge of an outer surface of the upper, the lower and the right and the left sideboard for H-shaped position members to fit in four L-shaped grooves of two back-back juxtaposed cabinet bodies. In this way, plural sets of two cabinet bodies in the superposed and juxtaposed condition can be constructed so as to make a large mass of plural assembled cabinets with convenience, quickness and stability.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
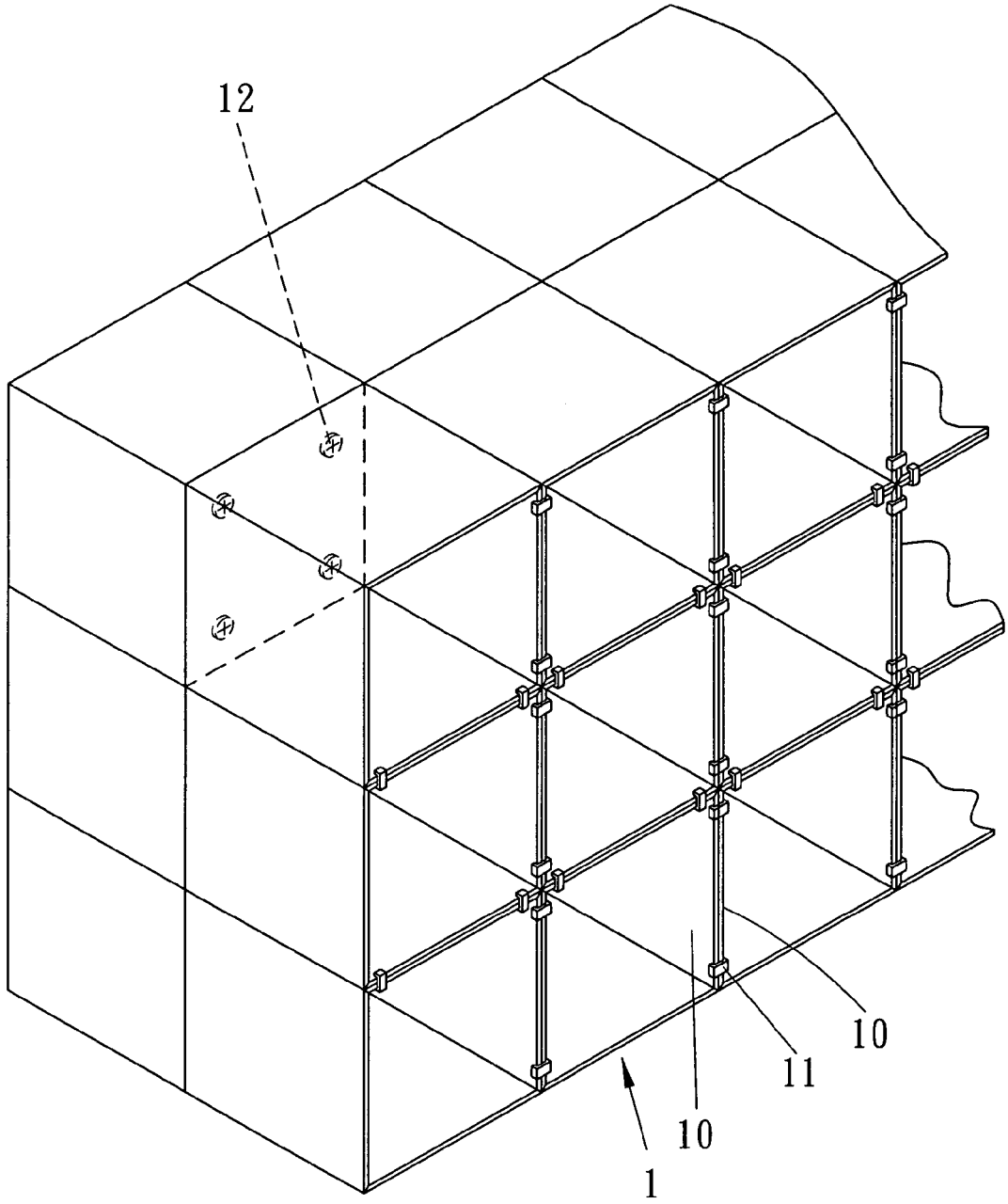
FIG.1 ( PRIOR ART )
FIG. 1 is a perspective view of plural conventional cabinets combined together.
Figure 2:
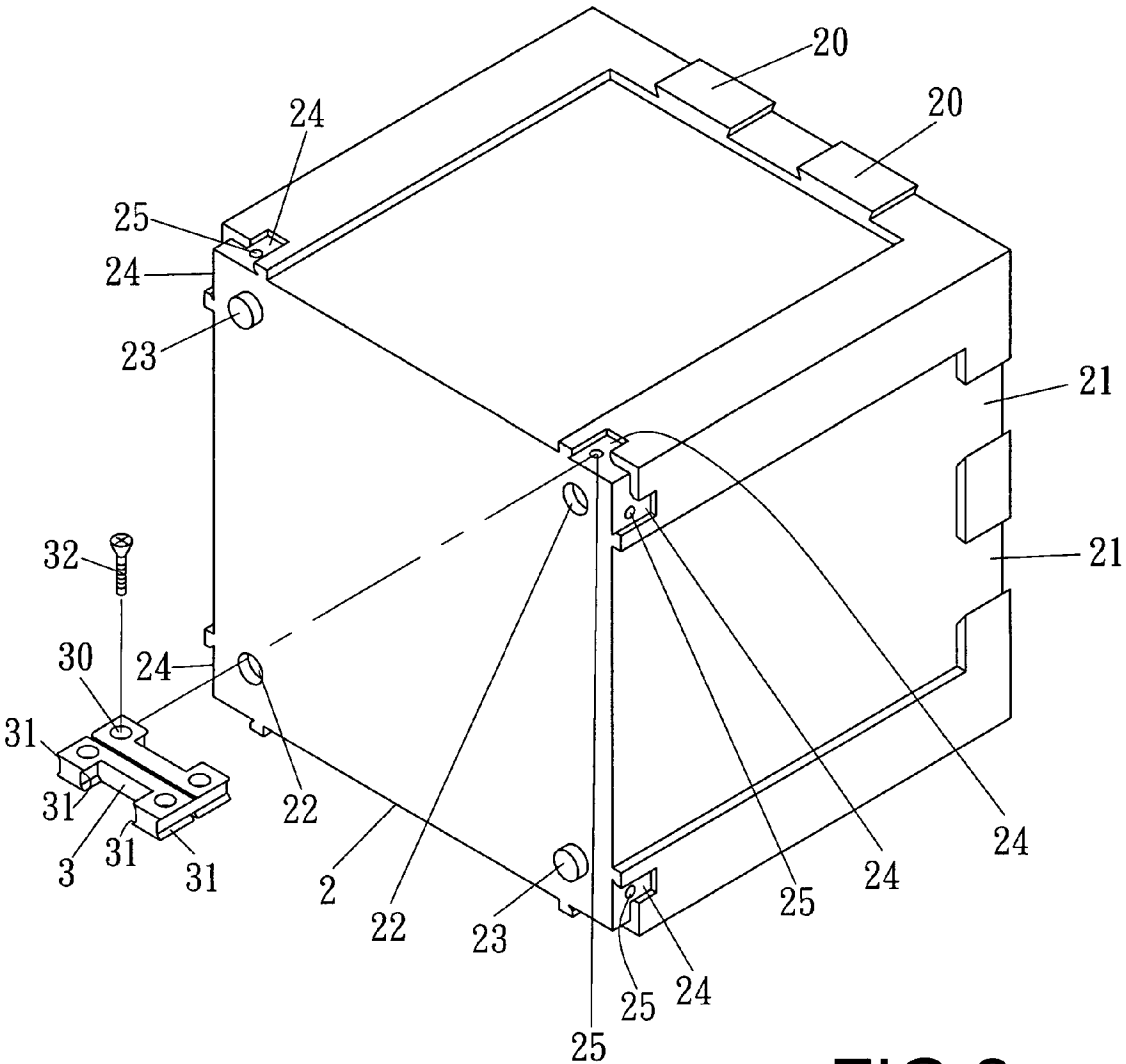
FIG. 2 is an exploded perspective view of a combinative cabinet in the present invention.
Figure 3:
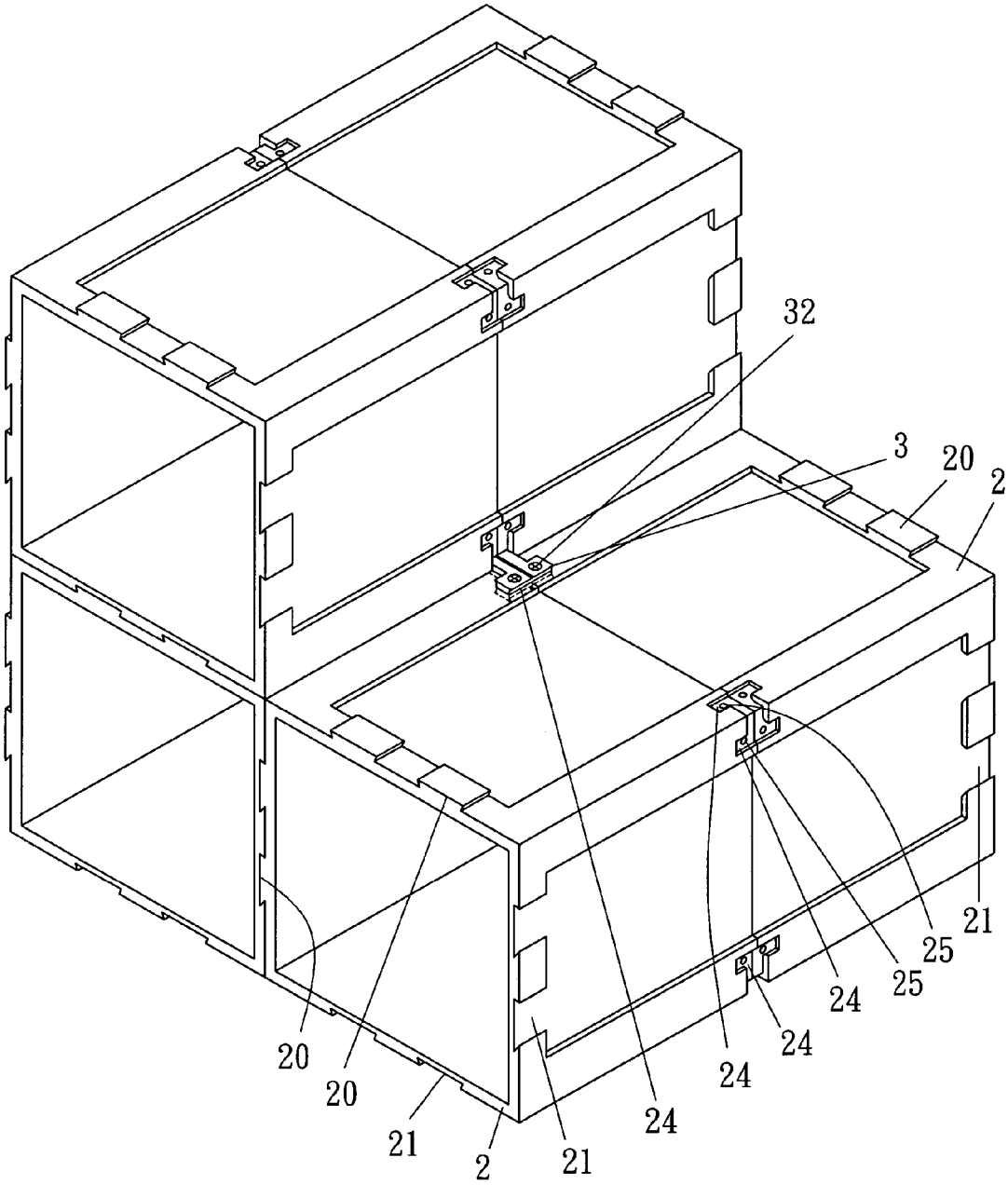
FIG. 3 is a perspective view of plural combinative cabinets combined together in the present invention.
Figure 4:
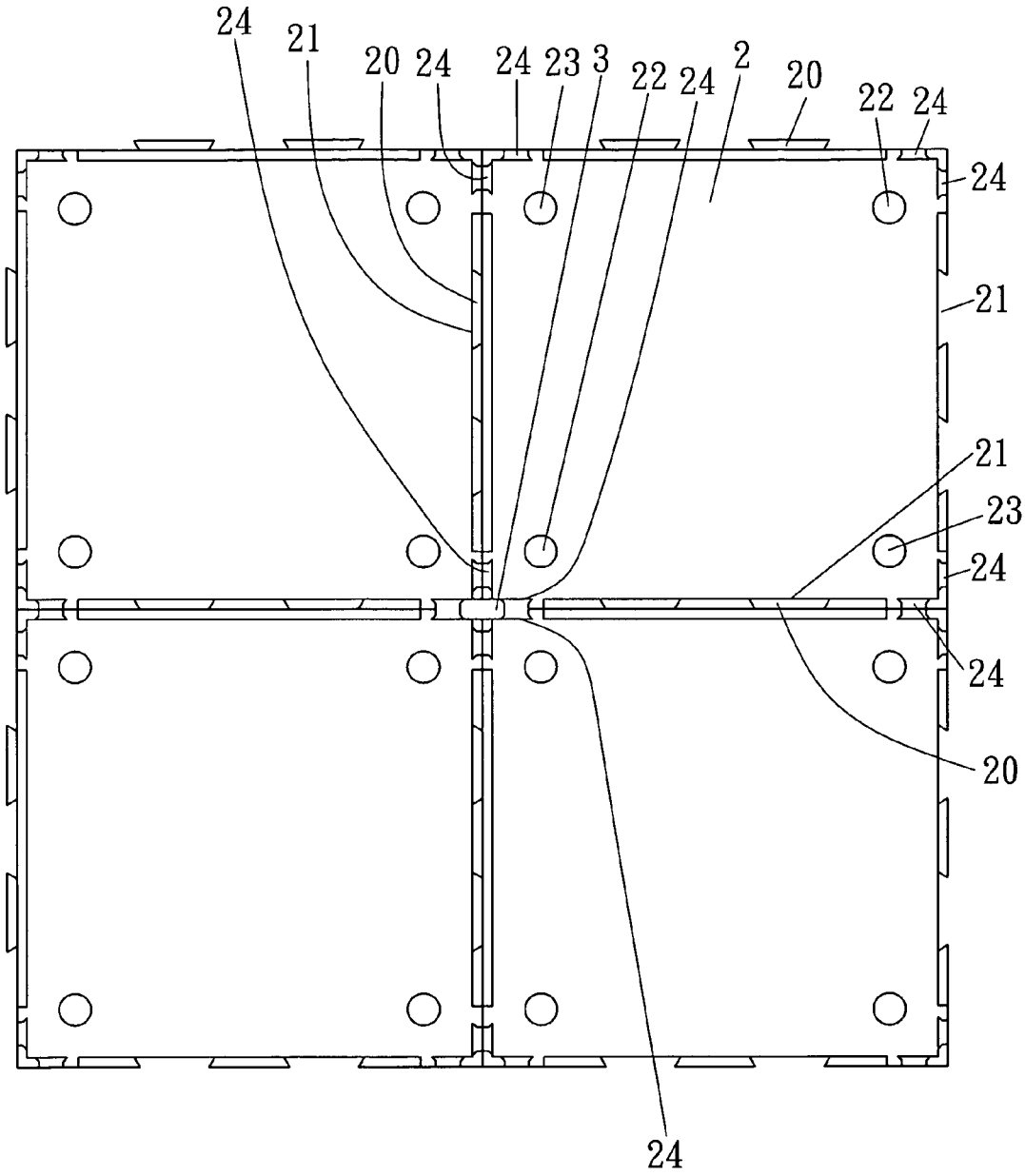
FIG. 4 is a rear view of plural combinative cabinets combined together in the present invention.

A preferred embodiment of conventional combinative cabinets in the present invention, as shown in FIGS. 2 and 3, respectively includes cabinet body 2 consisting of five boards—an upper, a lower, a right, a left, and a rear side—with an open front side and plural position members 3 as main components.

The upper side board and a left side board respectively have two dovetail-shaped projections 20 spaced apart by a dovetail-shaped groove 21 respectively on a front edge of an outer surface, and the lower side board and a right side board respectively have two dovetail-shaped grooves spaced apart by a dovetail-shaped projections on a front edge of an outer surface. The rear side board as two holes 22 and two short bars 23 formed diagonally at four corners of a rear board, and an L-shaped insert groove 24 with a threaded holes 25 are respectively formed at two rear corners of the rear side of the upper side board, the lower side board, the right side board and the left side board.

The position members 3 are respectively H-shaped, having a hole 30 respectively in four corners, which are shaped respectively as a dovetail-shaped projection 31, and a fastening member 32 engaging with each hole 30. Each position member 3 is bent in a right angle in a bent condition and then fitted in four L-shaped insert grooves 24 of two neighboring cabinet bodies 2 juxtaposed back to back.

Figure 5:
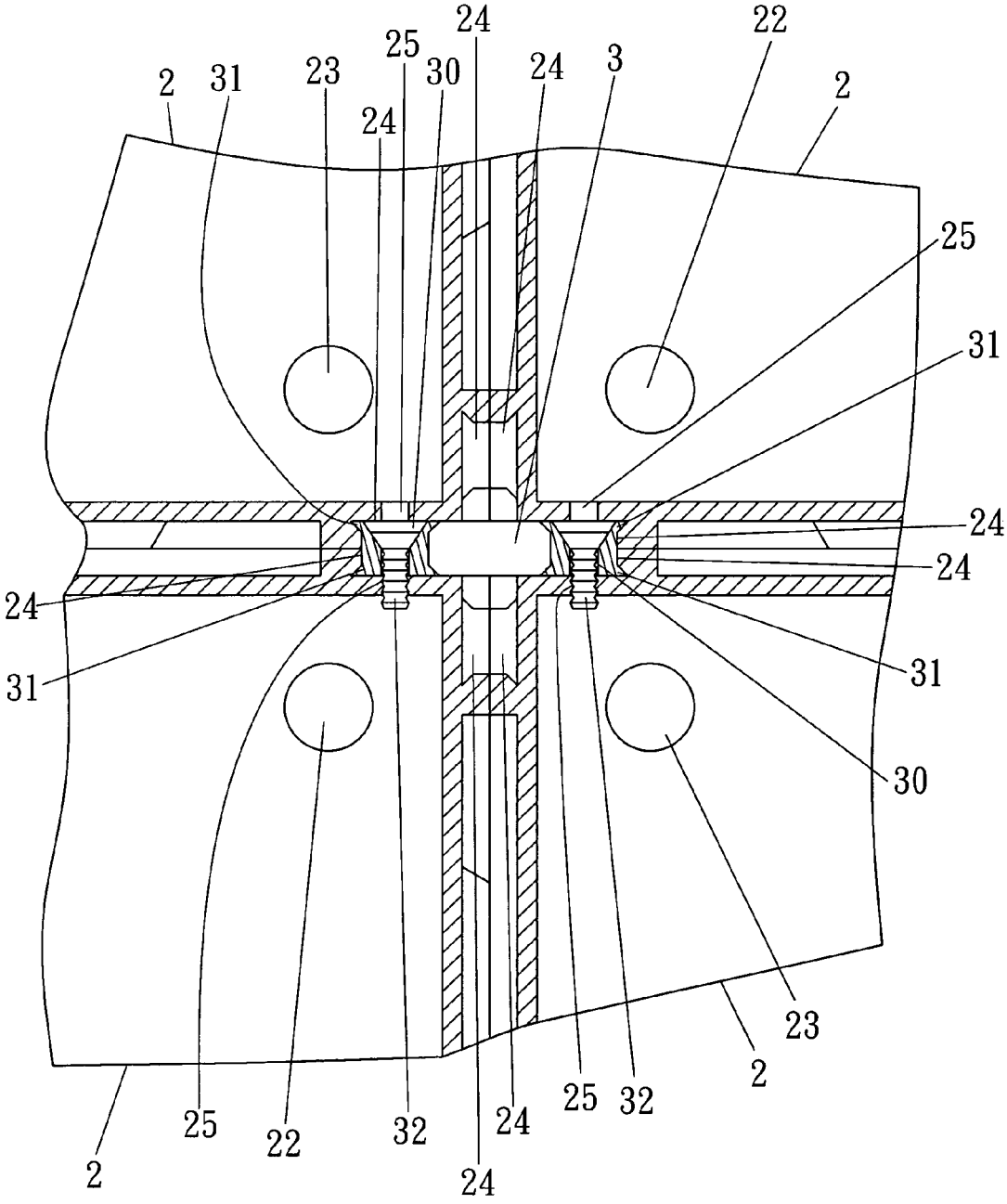
FIG. 5 is a partial cross-sectional view of plural combinative cabinets combined together in the present invention; and, FIG. 6 is a side cross-sectional view of plural combinative cabinets combined together in the present invention.
Figure 6:
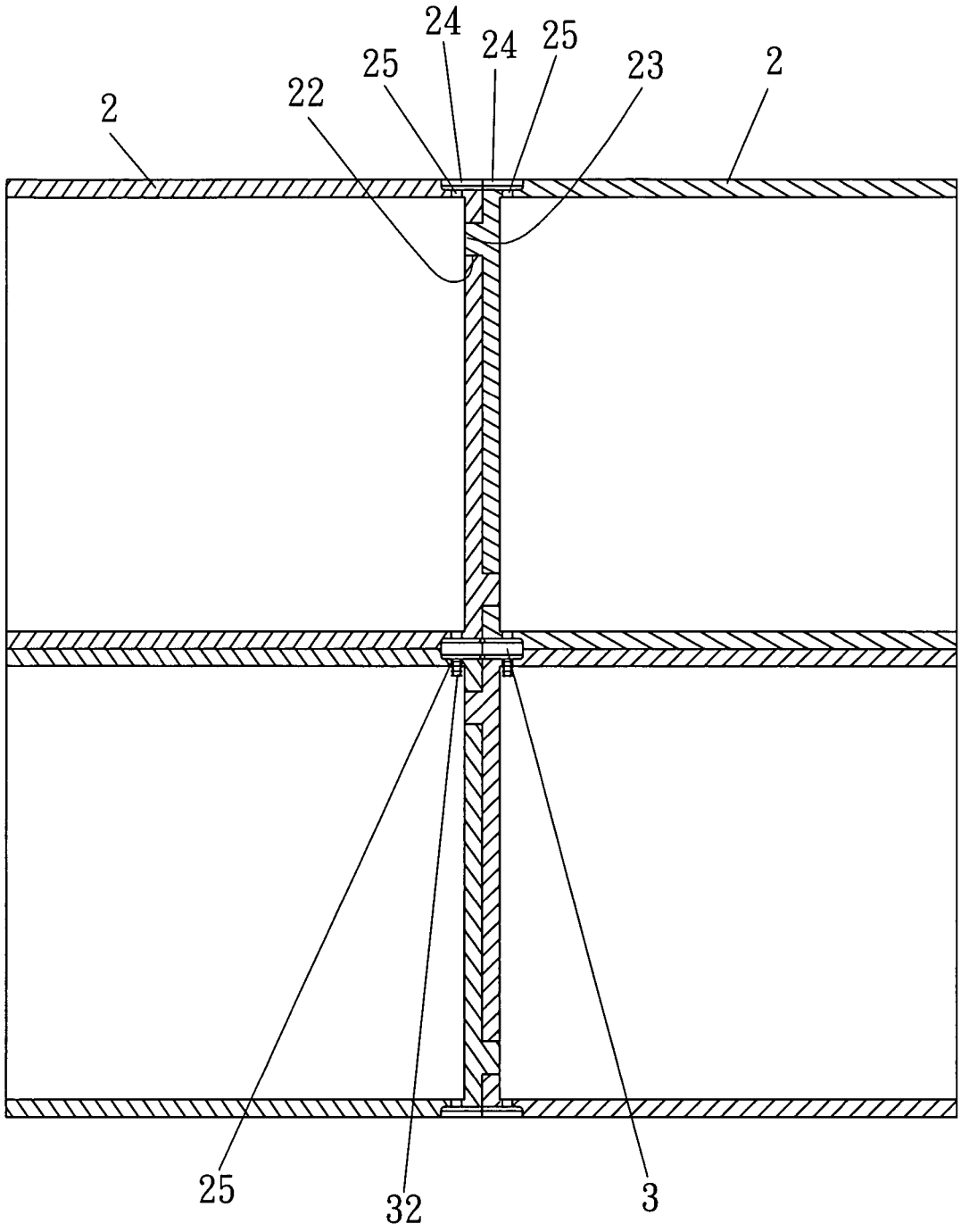

In assembling, referring to FIGS. 2, 3, 4 and 5, firstly, two cabinet bodies 2 are juxtaposed or superposed, by engaging the dovetail-shaped projections 20 of the left side board of a first cabinet body 2 with the 20 dovetail-shaped grooves 21 of the right side board of a second cabinet body 2, or by engaging the dovetail-shaped projections 20 of the upper side board of the first cabinet body 2 with the dovetail-shaped grooves 21 of the lower side board of the second cabinet body 2. Then the position member 3 is fitted tightly in a bent condition in the insert grooves 24 25 of the first and the second L-shaped grooves 24, with the fastening members 32 engaging in the holes 30 of the position member 3 and also in the holes 25 of the cabinet body 2, as shown in FIG. 5.

Next, two sets of two combined-side-by-side cabinet bodies 2 can be combined by juxtaposing them back to back, letting the insert portions 31 of the position members 3 of the first set of the combined cabinet bodies 2 fitting in the insert grooves 24 of the second set of the combined cabinet bodies 2 and with the fastening members 3 inserting in the holes 30 and the holes 25, and with the short bars 23 and the holes 22 of the first set of the combine cabinet bodies 2 fitting with the holes 22 and the short bars 23 of the second set of the combined cabinet bodies 2, so the two sets of the two combined cabinet bodies 2 may be stably assembled together.

In this way, two sets of the four combined cabinet bodies 2 may be assembled together by superposing one set on the other set or juxtaposing then side by side. Then this process may be continued to make a large mass of combined cabinet bodies 2 with convenience, fastness and stability.

While the preferred embodiment of the invention has been described above, it will be recognized and understood that various modifications may be made therein and the appended claims are intended to cover all such modifications that may fall within the spirit and scope of the invention.

What is claimed is:

1. A combinative cabinet comprising:

a cabinet body formed with five side boards and with an open front side, an upper side board provided with two dovetail-shaped projections spaced apart by a dovetail-shaped groove on a front edge of an outer surface, a lower side board provided with two dovetail-shaped grooves spaced apart by a dovetail-shaped projection on a front edge of an outer surface, a right side board provided with two dovetail-shaped grooves spaced apart by a dovetail projection on a front edge of an outer surface, a left side board provided with two projections spaced apart by a dovetail-shaped groove on a front edge of an outer surface, said upper board and said right side board and left side board respectively having an L-shaped insert groove respectively formed at two rear corners;

plural position members of an H-shape respectively having four projections at four corners, said plural position members bent in a right angle and then fitted in the related L-shaped grooves of said upper and said lower side board and said right and said left side board for stabilizing said cabinet bodies assembled together; and, every two of said cabinet bodies assembled together by juxtaposing or superposing with said dovetail-shaped projections engaging with said dovetail-shaped grooves of said upper and said lower side board and said right and said left side board and with said position members in said L-shaped grooves so as to construct a large mass of plural cabinet bodies assembled together.

2. The combinative cabinet as claimed in claim 1, wherein a rear side board of said cabinet body is provided with plural holes and plural short bars.

3. The combinative cabinet as claimed in claim 1, wherein said insert grooves of said cabinet body are respectively provided with a threaded hole, and said position members are respectively provided with a hole in each of said four corners, and a fastening member engages with each said hole of said four corners of said each said position member and also with said threaded hole of said cabinet body.

* * * * *